US005148680A

United States Patent [19]

Dray

[11] Patent Number: 5,148,680

[45] Date of Patent: Sep. 22, 1992

[54] CRYOGENIC AIR SEPARATION SYSTEM WITH DUAL PRODUCT SIDE CONDENSER

[75] Inventor: James R. Dray, Kenmore, N.Y.

[73] Assignee: Union Carbide Industrial Gases Technology Corporation, Danbury, Conn.

[21] Appl. No.: 544,641

[22] Filed: Jun. 27, 1990

[51] Int. Cl.[5] ..... F25J 3/02

[52] U.S. Cl. ..... 62/24; 62/43

[58] Field of Search ..... 62/13, 23, 24, 43

[56] References Cited

U.S. PATENT DOCUMENTS

| | | | |
|---|---|---|---|
| 2,712,738 | 7/1955 | Wucherer et al. | 62/175.5 |
| 2,915,882 | 12/1959 | Schuftan et al. | 62/30 |
| 3,059,440 | 10/1962 | Loporto | 62/11 |
| 3,102,801 | 9/1963 | Fetterman | 62/31 |
| 3,214,925 | 11/1965 | Becker | 62/13 |
| 3,269,130 | 8/1966 | Cost et al. | 62/30 |
| 3,280,574 | 10/1966 | Becker | 62/13 |
| 3,754,406 | 8/1973 | Allam | 62/41 |
| 3,905,201 | 9/1975 | Coveney et al. | 62/13 |
| 4,299,607 | 11/1981 | Okabe et al. | 62/13 |
| 4,345,925 | 8/1982 | Cheung | 62/13 |
| 4,560,398 | 12/1985 | Beddome et al. | 62/29 |
| 4,836,836 | 6/1989 | Bennett et al. | 62/22 |
| 4,895,583 | 1/1990 | Flanagan et al. | 62/24 |

*Primary Examiner*—Ronald C. Capossela
*Attorney, Agent, or Firm*—Stanley Ktorides

[57] ABSTRACT

A cryogenic air separation system wherein pressurized feed air is at least partially condensed to vaporize elevated pressure liquid nitrogen and elevated pressure liquid oxygen to produce elevated pressure nitrogen and oxygen gas eliminating or reducing the need for product compression.

24 Claims, 3 Drawing Sheets

CRYOGENIC AIR SEPARATION SYSTEM WITH DUAL PRODUCT SIDE CONDENSER

TECHNICAL FIELD

This invention relates generally to the field of cryogenic air separation and more particularly to the cryogenic separation of air to produce oxygen and nitrogen.

BACKGROUND ART

The cryogenic separation of air to produce oxygen and nitrogen is a well established industrial process. Liquid and vapor are passed in counter-current contact through one or more columns and the difference in vapor pressure between the oxygen and nitrogen cause nitrogen to concentrate in the vapor and oxygen to concentrate in the liquid. The lower is the pressure in the separation column, the easier is the separation into oxygen and nitrogen due to vapor pressure differential. Accordingly the final separation into product oxygen and nitrogen is generally carried out at a relatively low pressure, usually just a few pounds per square inch (psi) above atmospheric pressure.

Often the product oxygen and nitrogen is desired at an elevated pressure. In such situations the product is compressed to the desired pressure in a compressor. This compression is costly in terms of energy costs as well as capital costs for the product compressors.

Accordingly it is an object of this invention to provide an improved cryogenic system for the production of oxygen and nitrogen.

It is a further object of this invention to provide an improved cryogenic system for the production of oxygen and nitrogen wherein oxygen and nitrogen may be produced at elevated pressure and thereby eliminate or reduce the need for product gas compression.

SUMMARY OF THE INVENTION

The above and other objects which will become apparent to one skilled in the art upon a reading of this disclosure are attained by the present invention one aspect of which is:

A method for the cryogenic separation of air to produce oxygen and nitrogen comprising:

(A) providing feed air into a higher pressure column and separating the feed air in the higher pressure column into nitrogen-enriched vapor and oxygen-enriched liquid;

(B) passing oxygen-enriched liquid from the higher pressure column into a lower pressure column;

(C) condensing nitrogen-enriched vapor to produce nitrogen-enriched liquid and passing nitrogen-enriched liquid into the lower pressure column;

(D) separating the fluids passed into the lower pressure column into nitrogen-rich vapor and oxygen-rich liquid;

(E) passing oxygen-rich liquid in indirect heat exchange with feed air to produce product oxygen gas; and (F) passing nitrogen-enriched liquid in indirect heat exchange with feed air to produce product nitrogen gas.

Another aspect of this invention is:

Apparatus for the cryogenic separation of air to produce oxygen and nitrogen comprising:

(A) heat exchange means;

(B) conduit means from the heat exchange means to a first column;

(C) conduit means from the first column to a second column;

(D) conduit means from the first column to a condenser/reboiler;

(E) means to pass fluid from the second column to the heat exchange means; and (F) means to pass fluid from the condenser/reboiler to the heat exchange means.

The term, "column", as used in the present specification and claims means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column or alternatively, on packing elements. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al, page 13-3, The Continuous Distillation Process. The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

The term "indirect heat exchange", as used in the present specification and claims, means the bringing of two fluid streams into heat exchange relation without any physical contact or intermixing of the fluids with each other.

As used herein, the term "packing" means any solid or hollow body of predetermined configuration, size, and shape used as column internals to provide surface area for the liquid to allow mass transfer at the liquid-vapor interface during countercurrent flow of the two phases.

As used herein, the term "condenser/reboiler" means a heat exchange device wherein vapor is condensed by indirect heat exchange with vaporizing column bottoms thus providing vapor upflow for the column.

As used herein, the term "structured packing" means packing wherein individual members have specific orientation relative to each other and to the column axis.

As used herein, the term "turboexpansion" means the flow of high pressure gas through a turbine to reduce the pressure and temperature of the gas and thereby produce refrigeration. A loading device such as a generator, dynamometer or compressor is typically used to recover the energy.

DETAILED DESCRIPTION

The method and apparatus of this invention will be described in detail with reference to the Drawings.

Figure 1:
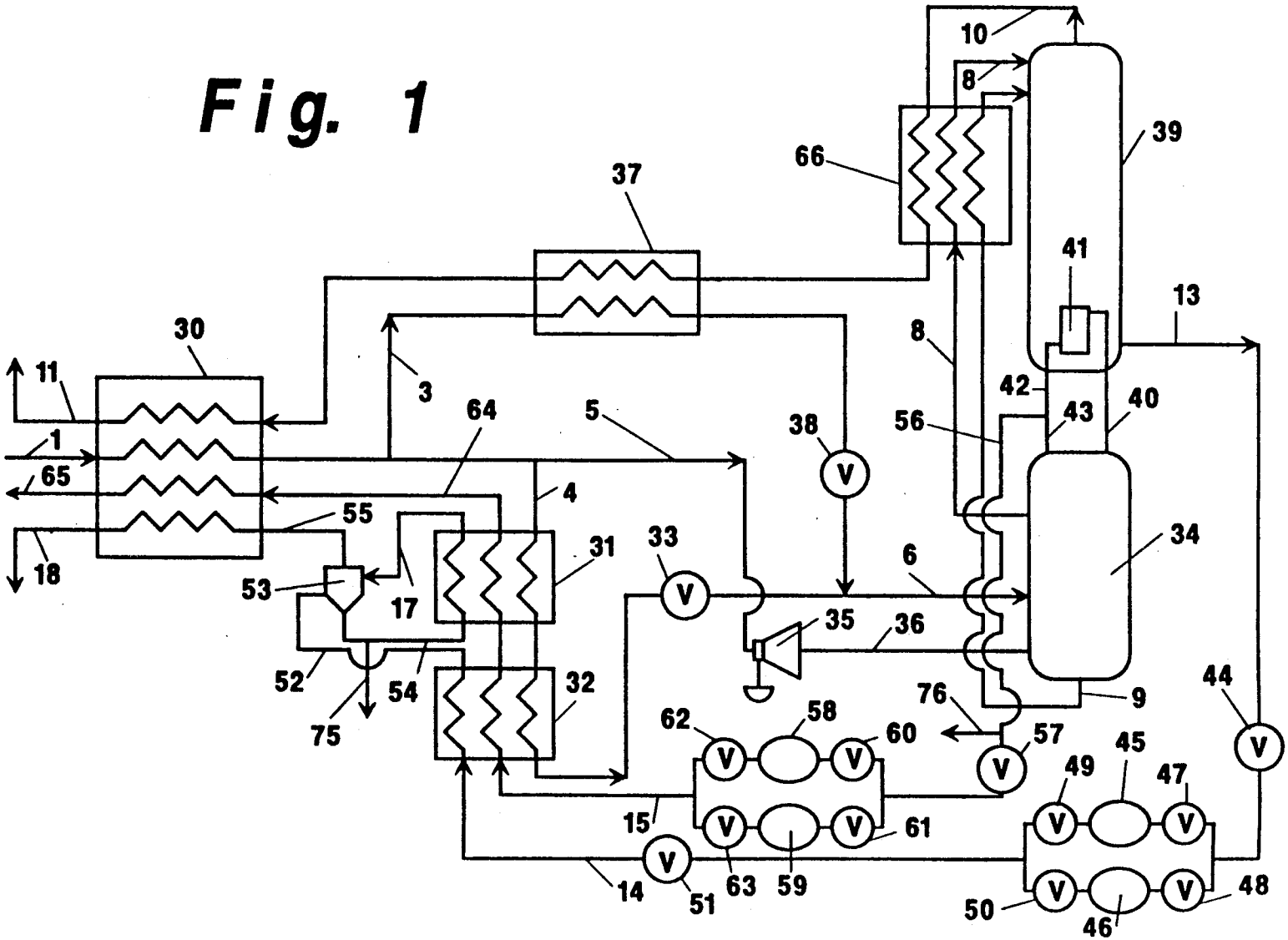
FIG. 1 is a schematic representation of one preferred embodiment of the method and apparatus of this invention.

Referring now to FIG. 1, clean, cool, compressed feed air 1 is cooled by indirect heat exchange in heat exchanger 30 against return streams. The feed air is at a pressure sufficient to vaporize liquid to produce elevated pressure product gas as will be more fully described below. Generally the feed air will be at a pressure within the range of from 90 to 500 pounds per square inch absolute (psia).

The feed air is divided into two portions. The first portion 4, which may be from 5 to 40 percent of the feed air, is passed through heat exchange means 31 which is a dual product side condenser. Air portion 4 is at least partially condensed in heat exchanger 31 and it may be totally condensed. Air portion 4 is then passed through conduit means to heat exchanger or subcooler 32 wherein it is subcooled and then through valve 33 and as stream 6 into first or higher pressure column 34 which is the higher pressure column of a double column system of an air separation plant. Higher pressure column 34 is generally operating at a pressure within the range of from 60 to 100 psia.

The second portion 5 of the feed air, which may comprise from 50 to 90 percent of the feed air, is turboexpanded through turboexpander 35 to develop refrigeration for the cryogenic separation. Expanded air portion 36 is then passed into higher pressure column 34.

A portion 3 of the feed air may be cooled by indirect heat exchange through heat exchanger 37 against low pressure nitrogen, passed through valve 38 and passed into higher pressure column 34 as part of stream 6. Alternatively, if the feed air portion 4 is only partially condensed by passage through dual product side condenser 31, the uncondensed part may be used to carry out the heat exchange in heat exchange 37 instead of or in addition to portion 3.

Within higher pressure column 34 the feed air is separated by cryogenic rectification into oxygen-enriched liquid and nitrogen-enriched vapor. Oxygen-enriched liquid is passed 9 through conduit means to heat exchanger 66 wherein it is cooled by indirect heat exchange with low pressure nitrogen and then passed into second or lower pressure column 39, which is operating at a pressure less than that at which higher pressure column 34 is operating, and generally within the range of from 15 to 30 psia. Nitrogen-enriched vapor is passed 40 through conduit means from higher pressure column 34 to condenser/reboiler 41 wherein it is condensed by indirect heat exchange with column 39 bottoms. Condenser/reboiler 41 is preferably within lower pressure column 39 although it may also be outside the column. Resulting nitrogen-enriched liquid 42 is passed out of condenser/reboiler 41 and a portion 43 is returned to higher pressure column 34 as reflux. Nitrogen-enriched liquid is passed 8 from higher pressure column 34 through heat exchanger 66 and into lower pressure column 39. Alternatively, a portion of liquid 42 could be passed as reflux to lower pressure column 39 instead of stream 8 from higher pressure column 34.

Within lower pressure column 39 the fluids fed into the column are separated into nitrogen-rich vapor and oxygen-rich liquid by cryogenic rectification. Nitrogen-rich vapor is removed 10 from lower pressure column 39 and this lower pressure nitrogen is warmed by sequential passage through heat exchanger 66, 37 and 30 and may be recovered as lower pressure nitrogen gas product 11. Oxygen-rich liquid serves to condense the nitrogen-enriched vapor in stream 40 and thus provides vapor upflow for lower pressure column 39.

A portion 13 of the oxygen-rich liquid is removed from lower pressure column 39 and is passed to dual product side condenser 31. In the preferred embodiment illustrated in FIG. 1 the oxygen-rich liquid is pressurized and thus is vaporized at elevated pressure in the dual product side condenser to produce elevated pressure oxygen gas product. Referring back to FIG. 1, oxygen-rich liquid 13 is passed through valve 44 into at least one tank. As illustrated in FIG. 1, the oxygen-rich liquid is passed into either or both of tanks 45 and 46 through valves 47 and 48 respectively and then through valves 49 and 50 respectively and through valve 51 and as stream 14 to subcooler 32. The tank or tanks serve to store product liquid oxygen for later delivery as product oxygen. The tank or tanks may be equipped with a pressure building coil or other means to raise the pressure of the oxygen-rich liquid. Alternatively the pressure of the oxygen-rich liquid may be increased by means of a liquid pump or by liquid head, i.e. the height differential between liquid levels. The pressurized oxygen-rich liquid is warmed by passage through subcooler 32 and resulting stream 52 is passed to phase separator 53. Oxygen-rich liquid 54 is passed from phase separator 53 through dual product side condenser 31 wherein it is partially vaporized and serves to carry out the condensation of the feed air which was discussed above. The two phase stream 17 is returned to phase separator 53 and vapor 55 is passed from phase separator 53 through heat exchanger 30 and is recovered as high pressure oxygen gas product stream 18. The high pressure oxygen gas product may have a pressure within the range of from 40 to 650 psia. Additionally, depending on available system refrigeration, some liquid products may be recovered. For example, liquid oxygen 75 and liquid nitrogen 76 can be produced along with the elevated pressure gas products.

Nitrogen-enriched liquid is passed from condenser/reboiler 41 to dual product side condenser 31. In the preferred embodiment illustrated in FIG. 1 the nitrogen-enriched liquid is pressurized and thus is vaporized at elevated pressure in the dual product side condenser to produce elevated pressure nitrogen gas product. Referring back to FIG. 1, nitrogen-enriched liquid is passed 56 through valve 57 into at least one tank. As illustrated in FIG. 1, the nitrogen-enriched liquid is passed into either or both of tanks 58 and 59 through valves 60 and 61 respectively and then through valves 62 and 63 respectively to subcooler 32. The tank or tanks serve to store product liquid nitrogen for later delivery as product nitrogen. The tank or tanks may be equipped with a pressure building coil or other means to raise the pressure of the nitrogen-enriched liquid. Alternatively the pressure of the nitrogen-enriched liquid may be increased by means of a liquid pump or liquid head. The pressurized nitrogen-enriched liquid 15 is warmed by passage through subcooler 32 and then is vaporized by passage through dual product side condenser 31 wherein it serves to carry out the condensation of the feed air which was discussed above. Nitrogen vapor stream 64 is passed through heat exchanger 30 and is recovered as high pressure nitrogen gas product stream 65. The high pressure nitrogen gas product may have a pressure within the range of from 100 to 600 psia.

The cryogenic system of this invention can produce nitrogen with a purity of at least 99 percent and up to a purity of 99.99 percent or more, and can produce oxygen with a purity within the range of from 95 to 99.95 percent. If desired some liquid oxygen and/or liquid nitrogen may be recovered directly from the columns without vaporization. Also, if desired, some gaseous oxygen or gaseous nitrogen could be recovered directly from the columns.

Figure 2:
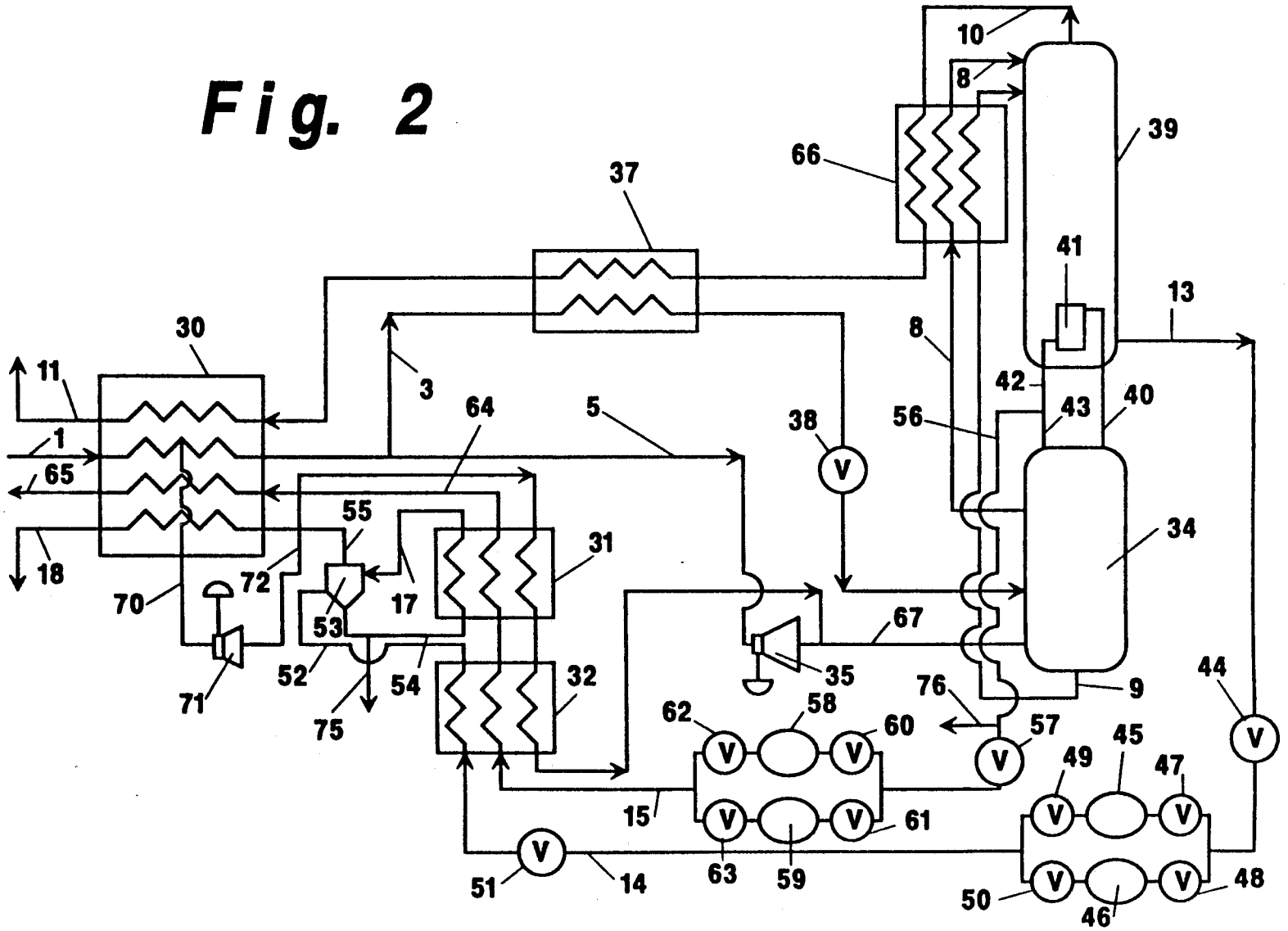
FIG. 2 is a schematic representation of another preferred embodiment of the method and apparatus of this invention.

FIG. 2 illustrates another embodiment of the invention wherein the first portion of the feed air is turboexpanded prior to passage through the dual product side condenser. The numerals in FIG. 2 correspond to those of FIG. 1 for the common elements and these common elements will not be described again. In the embodiment illustrated in FIG. 2, first portion 70 of the clean, cool, compressed feed air is taken from about the midpoint of heat exchanger 30 and turboexpanded through turboexpander 71. The resulting first feed air portion 72 is then passed through heat exchangers 31 and 32 and then combined with the second portion of the feed air downstream of turboexpander 35 and passed into higher pressure column 34 as stream 67. With the embodiment illustrated in FIG. 2, the additional feed air turboexpansion provides additional refrigeration to the columns thus enabling the production of more liquid products. However the gaseous products would be produced at lower pressures.

Figure 3:
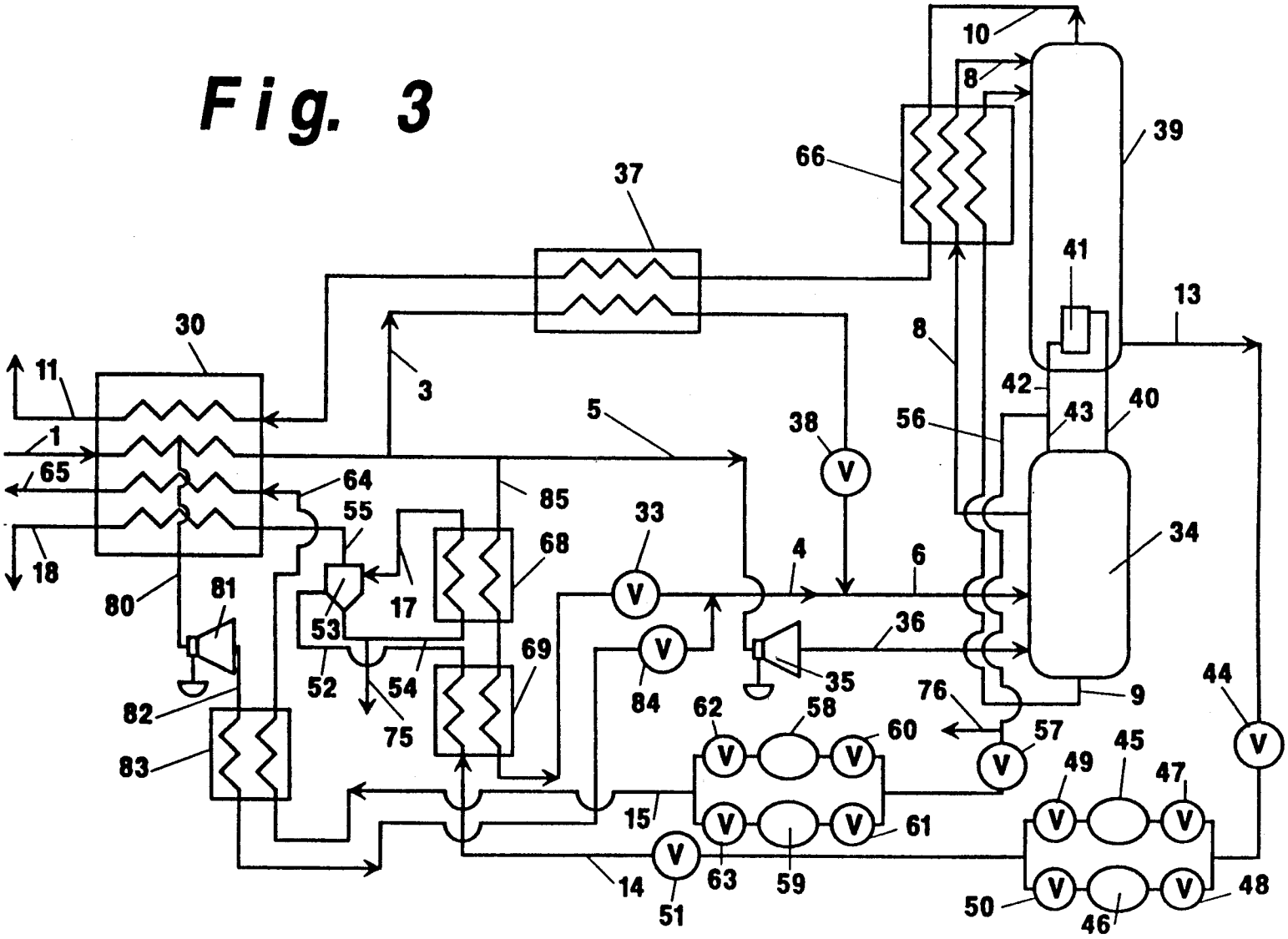
FIG. 3 is a schematic representation of yet another preferred embodiment of the method and apparatus of this invention.

FIG. 3 illustrates another embodiment of the invention wherein a part of the first portion of feed air is turboexpanded and then passed through a separate side condenser against nitrogen-enriched liquid. The numerals in FIG. 3 correspond to those of FIG. 1 for the common elements and these common elements will not be described again. In the embodiment illustrated in FIG. 3, part 80 of the first portion of the clean, cool, compressed feed air is taken from about the midpoint of heat exchanger 30 and turboexpanded through turboexpander 81. The resulting feed air part 82 is then passed through heat exchanger 83 and then through valve 84, combined with a second part 85 of the first feed air portion, which has passed through heat exchangers 68 and 69, to form part 4 and is then passed into higher pressure column 34. The heat exchange in heat exchanger 83 is against nitrogen-enriched liquid 15 which is then passed through heat exchanger 30 and recovered as elevated pressure nitrogen product gas. Thus in the embodiment illustrated in FIG. 3 the dual product side condenser is in two parts, i.e. heat exchangers 68 and 83. With the embodiment illustrated in FIG. 3 one can produce two products at independent pressures. Moreover, with the embodiment illustrated in FIG. 3, one can produce additional liquid over that attainable with the embodiment illustrated in FIG. 1 although not as much as with the embodiment illustrated in FIG. 2.

The column internals for either or both of the higher and lower pressure columns may comprise trays or packing. If packing is used the packing may be either random or structured packing. However the invention is particularly suited for use with structured packing column internals. This is because packing will reduce the operating pressures in the columns, helping to improve product recoveries and increase liquid production. Additional stages can be added to packed columns without significantly increasing the operating pressure of the column. Structured packing is preferred over random packing because its performance is more predictable and more stages can be attained in a given bed height. This is important to the first cost and complexity of the system.

Table I lists a summary of a computer simulation of the invention carried out with the embodiment illustrated in FIG. 1. The data in Table I is presented for illustrative purposes and is not intended to be limiting. The stream numbers in Table I correspond to those of FIG. 1.

TABLE I

| Stream No. | Temp. (°F.) | Pressure (PSIA) | Flowrate (MCFH) | Concentration (Mole Percent) $N_2$ | $O_2$ |
|---|---|---|---|---|---|
| 1 | 44 | 126 | 1000 | 78 | 21 |
| 4 | −252 | 125 | 265 | 78 | 21 |
| 5 | −252 | 125 | 713 | 78 | 21 |
| 6 | −282 | 82 | 287 | 78 | 21 |
| 36 | −273 | 82 | 713 | 78 | 21 |
| 8 | −289 | 79 | 382 | 99 | 1 |
| 9 | −282 | 82 | 618 | 65 | 33 |
| 10 | −316 | 19 | 770 | 98 | 1 |
| 11 | 43 | 15 | 770 | 98 | 1 |
| 56 | −288 | 79 | 30 | 100 | 0 |
| 65 | 43 | 135 | 20 | 100 | 0 |
| 13 | −290 | 22 | 200 | 0 | 99.6 |
| 18 | 43 | 45 | 193 | 0 | 99.6 |
| 75 | −290 | 45 | 7 | 0 | 99.6 |
| 76 | −288 | 79 | 10 | 100 | 0 |

Although the invention has been described in detail with reference to certain specific embodiments, those skilled in the art will recognize that there are other embodiments of the invention within the spirit the scope of the claims.

I claim:

1. A method for the cryogenic separation of air to produce oxygen and nitrogen comprising:

(A) providing feed air into a higher pressure column and separating the feed air in the higher pressure column into nitrogen-enriched vapor and oxygen-enriched liquid;

(B) passing oxygen-enriched liquid from the higher pressure column into a lower pressure column;

(C) condensing nitrogen-enriched vapor to produce nitrogen-enriched liquid and passing nitrogen-enriched liquid into the lower pressure column;

(D) separating the fluids passed into the lower pressure column into nitrogen-rich vapor and oxygen-rich liquid;

(E) passing oxygen-rich liquid in indirect heat exchange with feed air to produce product oxygen gas; and (F) passing nitrogen-enriched liquid produced by the condensation of nitrogen-enriched vapor in step (C) against oxygen-rich liquid in indirect heat exchange with feed air to produce product nitrogen gas.

2. The method of claim 1 wherein the feed air is divided into a first portion and a second portion and the first portion is at least partly condensed by the heat exchange of steps (E) and (F).

3. The method of claim 2 wherein the first portion of the feed air is totally condensed by the heat exchange of steps (E) and (F).

4. The method of claim 2 wherein the second portion is turboexpanded prior to its introduction into the higher pressure column.

5. The method of claim 2 wherein the first portion of the feed air is turboexpanded prior to the heat exchange of steps (E) and (F).

6. The method of claim 2 wherein the first portion of the feed air is divided into a first part and a second part, the first part is turboexpanded and then used to carry out the heat exchange of step (F), and the second part is used to carry out the heat exchange of step (E).

7. The method of claim 1 further comprising recovering nitrogen rich vapor taken from the lower pressure column.

8. The method of claim 1 wherein the nitrogen-enriched vapor is condensed by indirect exchange with oxygen-rich liquid.

9. The method of claim 1 wherein the pressure of the oxygen-rich liquid is increased prior to the heat exchange of step (E).

10. The method of claim 1 wherein the pressure of the nitrogen-enriched liquid is increased prior to the heat exchange of step (F).

11. The method of claim 1 further comprising recovering some oxygen-rich liquid.

12. The method of claim 1 further comprising recovering some nitrogen-enriched liquid.

13. Apparatus for the cryogenic separation of air to produce oxygen and nitrogen comprising:

(A) heat exchange means;

(B) conduit means from the heat exchange means to a first column;

(C) conduit means from the first column to a second column;

(D) conduit means from the first column to a condenser-reboiler;

(E) means to pass fluid from the lower portion of the second column to the heat exchange means; and (F) means to pass fluid from the condenser/reboiler to the heat exchange means.

14. The apparatus of claim 13 wherein the means to pass fluid from the second column to the heat exchange means comprises at least one tank.

15. The apparatus of claim 13 wherein the means to pass fluid from the condenser/reboiler to the heat exchange means comprises at least one tank.

16. The apparatus of claim 13 wherein the means to pass fluid from the second column to the heat exchange means comprises a liquid pump.

17. The apparatus of claim 13 wherein the means to pass fluid from the condenser/reboiler to the heat exchange means comprises a liquid pump.

18. The apparatus of claim 13 further comprising a turboexpander in flow communication with the first column.

19. The apparatus of claim 13 further comprising subcooler means on the conduit means from the heat exchange means to the first column.

20. The apparatus of claim 13 further comprising a turboexpander in flow communication with the heat exchanger means.

21. The apparatus of claim 13 wherein the heat exchanger means comprises a first part and a second part, the passage means of part (E) is adapted to pass fluid to the second part and the passage means of part (F) is adapted to pass fluid to the first part.

22. The apparatus of claim 21 further comprising a turboexpander in flow communication with the second part.

23. The apparatus of claim 13 wherein at least some of the internals of the first column comprise structured packing.

24. The apparatus of claim 13 wherein at least some of the internals of the second column comprise structured packing.

* * * * *